US007491032B1

(12) United States Patent
Powell et al.

(10) Patent No.: US 7,491,032 B1
(45) Date of Patent: Feb. 17, 2009

(54) ORGANIC MATRIX COMPOSITE INTEGRALLY BLADED ROTOR

(75) Inventors: Christopher Alan Powell, Cardiff (GB); David Anthony Williams, Bristol (GB)

(73) Assignee: Rolls Royce PLC, London (GB)

( * ) Notice: Subject to any disclaimer, the term of this patent is extended or adjusted under 35 U.S.C. 154(b) by 469 days.

(21) Appl. No.: 11/473,134

(22) Filed: Jun. 23, 2006

(30) Foreign Application Priority Data

Jun. 30, 2005 (GB) ..... 0513383.0

(51) Int. Cl.
*F01D 5/34* (2006.01)

(52) U.S. Cl. ..... 416/230; 416/229 R; 416/234; 29/889.71

(58) Field of Classification Search ..... 416/234, 416/230, 229 A, 229 R; 29/889.7, 889.71, 29/889.21

See application file for complete search history.

(56) References Cited

U.S. PATENT DOCUMENTS

| | | | | |
|---|---|---|---|---|
| 4,363,602 | A | 12/1982 | Martin | |
| 4,576,770 | A | 3/1986 | Schultz | |
| 4,747,900 | A | 5/1988 | Angus | |
| 4,786,347 | A | 11/1988 | Angus | |
| 5,222,866 | A * | 6/1993 | LaBrouche et al. | 416/230 |
| 5,921,754 | A * | 7/1999 | Freitas et al. | 416/230 |
| 2004/0042902 | A1 | 3/2004 | Hornick et al. | |

FOREIGN PATENT DOCUMENTS

| | | |
|---|---|---|
| EP | 0 710 728 A1 | 5/1996 |
| EP | 1 396 608 A2 | 3/2004 |
| GB | 127532 A | 6/1971 |
| GB | 1244349 A | 8/1971 |
| GB | 2117844 B | 10/1983 |
| GB | 2161108 B | 1/1986 |
| GB | 2161110 B | 1/1986 |

* cited by examiner

*Primary Examiner*—Edward Look
*Assistant Examiner*—Dwayne J White
(74) *Attorney, Agent, or Firm*—Oliff & Berridge, PLC

(57) ABSTRACT

An integrally bladed rotor is constructed from a plurality of layers of organic matrix composite material wound together in a spiral fashion to form the disc portion of the rotor, and at each rotor blade position at least the outermost one of the layers is turned substantially radially outwards from the periphery of the rotor disc to form a blade. Each blade is finished with further pieces of organic matrix composite material bonded into position on the. An encircling blade tip shroud may be formed by further layers of material wound around the tips of the blades in conjunction with closed loop inserts in the spaces between blades.

16 Claims, 2 Drawing Sheets

ORGANIC MATRIX COMPOSITE INTEGRALLY BLADED ROTOR

The present invention relates to an organic matrix composite integrally bladed rotor. In particular it concerns such a rotor for use in gas turbine engines.

Integrally bladed rotors, or bladed discs often called blisks (based on the alternative spelling disk) are known in the art. Hitherto, in practice these blisks have been manufactured of metallic materials usually as single items machined from a solid metal billet or as several items welded together. Despite having a number of advantages over conventional rotor assemblies employing a forged metal disc and cast metal blades, metal blisks retain a disadvantage of the relatively heavy weight of the basic material. Compared to organic matrix composite materials metals have a lower specific strength and have very little inherent damping, so can be subject to large amplitudes of vibration.

Organic matrix composite integrally bladed rotors used in gas turbine engines are subject to large forces which must be taken into account in designing the construction of the rotor to preserve its integrity. In the rotor disc the major forces are exerted in circumferential directions so an ability to absorb hoop stress is important, whereas in the aerofoil blades radially exerted forces predominate. The organic matrix material, usually an epoxide polymer resin (or epoxy), has low inherent strength but the matrix has a specific strength higher than that of metal due to the inclusion of fibres normally of the same material embedded in the matrix. The fibres are strongest in tension so the direction of the forces in the finished component will determine its strength. In some instances the structural design of the component has been influenced by the need for fibre orientation.

Our earlier published patents GB 2,161,108B (U.S. Pat. No. 4,747,900) and GB 2,161,110B (U.S. Pat. No. 4,786,347) described a compressor assembly comprising a shaft and at least one disc having integral radially extending blades. The assembly comprised a carbon fibre reinforced organic matrix material in which short lengths of chopped reinforcing fibres were generally axially aligned in the shaft portion and radially aligned in the aerofoil blades. Further radial support for the aerofoil blades was provided by a shroud ring, which encircled the blade tips and was reinforced by at least one continuous filament would into the support ring. In the manufacturing process a mixture of chopped fibres and matrix material was injected into a die at locations that determined the fibres were generally aligned with the desired direction.

Patent GB 2,117,844B (U.S. Pat. No. 4,576,770) described a method of manufacturing a fibre reinforced rotor and blade assembly in which a number of circular arrays were stacked to the axial thickness of the rotor. Each array comprised a radial array of fibres arranged in a starburst pattern centred on a paper disc and supported by a rigid annular ring. The radial fibres were formed into blade groupings; the aerofoil shape of the blades was determined by pressing together corresponding groups of fibres in the stacked arrays. To form the disc portion further fibres were woven in an axial direction among the radial fibres to close the space near the central paper disc and layered with fibres wound in a circumferential direction around the radial fibres.

US Patent Application 2004/0042902A1 (European equivalent EP 1,396,608A2) disclosed an integrally bladed rotor in which the plurality of blades were arranged in pairs. Each Pair of blades was arranged at opposite ends of a spar in which the reinforcing fibres were generally axially aligned with the longitudinal axis of the spar. The rotor may, or may not, further comprise an outer shroud joined to the blade tips although how hoop forces were contained in the absence of a shroud ring was not discussed.

The manufacturing technique of injecting a resin containing chopped fibres into a die, as disclosed in our earlier patents, although relatively straightforward, and may be carried out largely by machine, suffers from disadvantages. Because the fibres are of relatively short lengths compared to a structure containing continuous fibres they are not capable of carrying as much load, and reinforcing fibre direction and alignment is not necessarily optimum.

The method of GB 2,117,844B, on the other hand, involves very well controlled fibre arrangement for maximum strength but it is very labour intensive and time-consuming and therefore produces a very expensive product. The method of US2004/0042902 is also regarded as difficult and costly to operate and, because the spars all cross on the axis line would not allow for a central axial bore. An annular disc portion, rather than a solid disc is usually considered as essential for assembly access and, in operation, is used as an air passage in an internal air system.

The present invention seeks to overcome these disadvantages by utilising a construction technique that has long fibre runs for strength, allows for a central bore and yet is relatively quick and easy to perform.

According to the present invention there is provided an integrally bladed rotor having a disc portion and upstanding from the periphery thereof a plurality of blades comprising in its construction a plurality of layers of organic matrix material wound together in a spiral fashion to form the disc portion, and in turn at each blade position at least the successively outermost one of said layers is turned substantially radially outwards to form a blade.

Preferably successive layers in turn are made upstanding to form successive blades spaced apart around the periphery of the disc.

The invention will now be described in greater detail with reference to the accompanying drawings in which.

Figure 1:
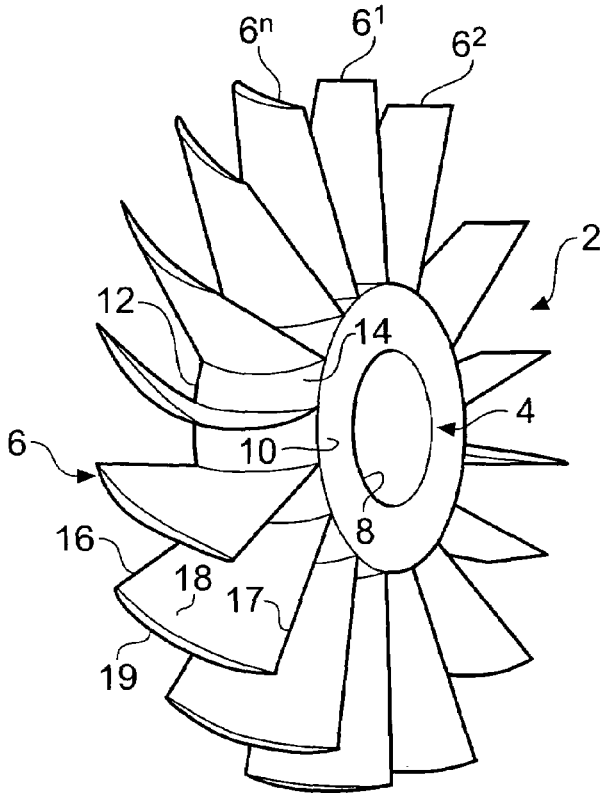
FIG. 1 shows a perspective view of a composite bladed rotor.

Referring now to the drawings, FIG. 1 shows a composite bladed rotor, generally indicated at 2, comprising a disc portion 4 and upstanding from the periphery thereof a plurality of blades, one of which is indicated at 6. In order to provide the aforementioned central bore for access etc. The disc 4 is roughly annular in shape with an inner circumferential surface 8 which in the illustrated example is of constant diameter between a visible, front face 10 and a hidden, rear face 12. The radially outer surface 14 of the disc 4 is represented here, for simplicity, as cylindrical also. That is the basic shape of the outer surface 14 of the disc portion is parallel to the inner surface 8. In practice, however, the shape of this surface 14 of the disc 4 normally, but not always, is frusto-conical, thus presenting a rising hub line to the gas path.

In an axial flow gas turbine engine compressor it is usual to have a rising hub line, which thereby provides the inner wall of the gas path with an increasing diameter rearwards in the direction of the combustor. The rotor illustrated here is of the kind found in the low pressure section of a gas turbine engine compressor. This is likely to be the most suitable location for a composite bladed rotor because of the relatively low temperature of the air entering the compressor and its lower rotational speed.

In accordance with the present invention the disc or hub portion 4 is formed of a plurality of layers of organic matrix material wound together in a spiral fashion. This layered form of construction is more clearly visible in the illustrations of FIGS. 2 and 3. The organic material used is carbon fibre woven into a cloth or tape, hereinafter called a ply-pack. In the method of construction described above the ply pack structure may be supported on mandrels and placed in a die The axial view of FIG. 2 of a cross section on a radial plane through the rotor of FIG. 1, more clearly illustrates the construction method used for the integrally bladed rotor 2. The transverse section through the rotor is taken on a plane perpendicular to the rotational axis 20 of the rotor, thus the ply-packs are seen side on as thin layers generally indicated at 22 in the illustration.

As mentioned above extending generally radially outwards from the peripheral surface 14 of the annular disc portion 4 of the rotor there is a plurality of blades 6, equidistantly spaced apart around the circumference 14 of the disc. There are "n" blades in a complete rotor set, and in FIGS. 2, 3 and 4 individual blades are given a suffix number corresponding to their position in the set. Thus, a first blade is referenced $\mathbf{6}^1$, the next blade is referenced $\mathbf{6}^2$ and so on up to the last and nth blade $\mathbf{6}^n$. The blades 6 are of conventional aerofoil shape, that is each has a leading edge 16, a trailing edge 17, a pressure side surface 18 and a suction side surface 19.

There are as many ply-packs 22 used in the construction of the rotor disc as there are blades 6. In this group each ply-pack contributes to the body of the disc and makes up the greater part of one half or side of a blade. The inner ends 24 of the ply-packs 22 are staggered around the inner circumference 8 and are wound in a spiral fashion, in this example in a clockwise direction. For support the ply packs may be mounted on a mandrel (not shown).

Figure 2:
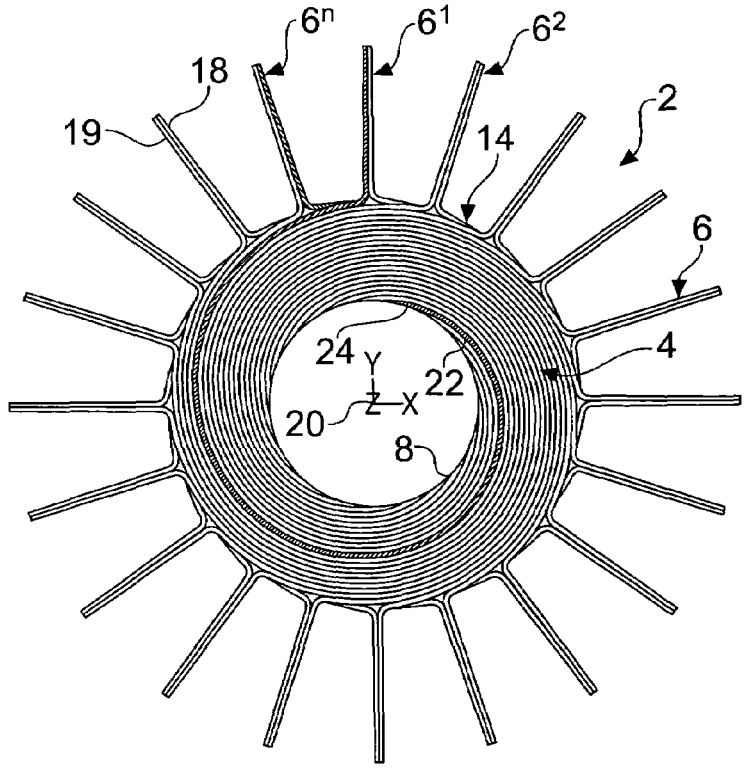
FIG. 2 is an axial view of a cross section on a radial plane through the rotor of FIG. 1.
Figure 3:
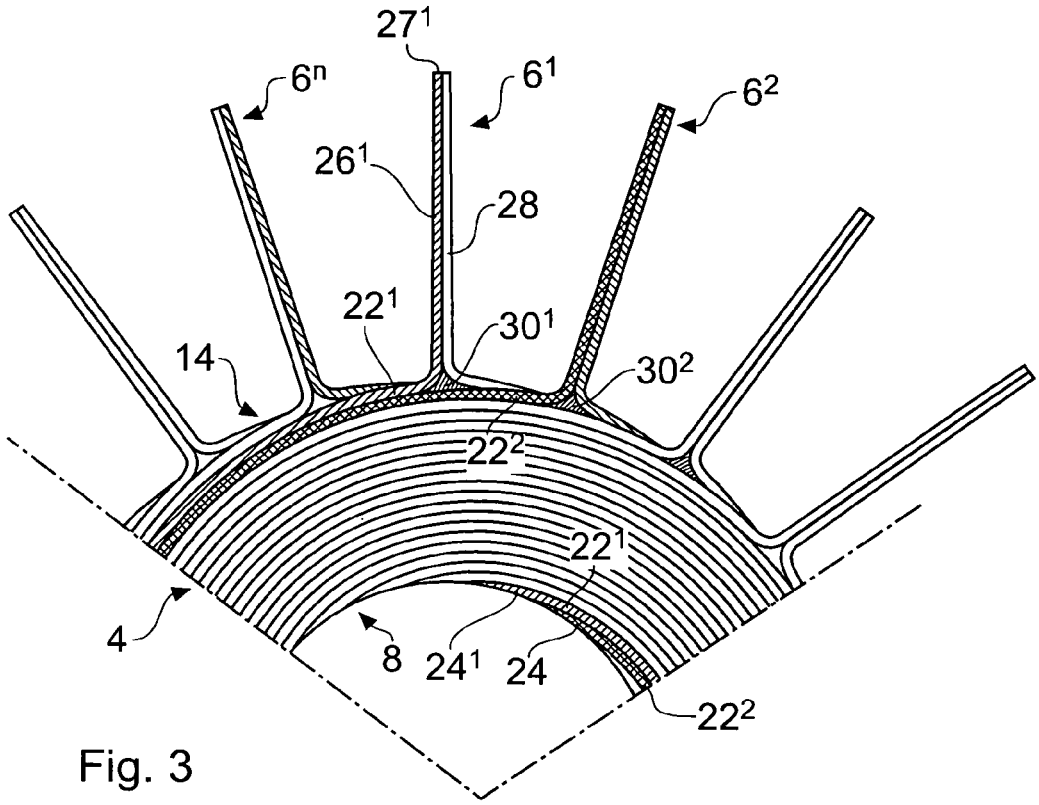
FIG. 3 shows a close up view of part of FIG. 2 to better illustrate the arrangement of material layers at a blade position in the rotor of FIGS. 1 and 2.

Referring now to FIGS. 2 and 3 at each blade position at the circumference 14 the outermost ply-pack is "peeled off" the periphery of the disc in a substantially radial direction to create the basis of a blade 6. Thus, at the first blade position 61 ply pack $\mathbf{22}^1$ is turned outwards to a generally radial direction to form the basis of the blade 61. As the ply pack $\mathbf{22}^1$ is peeled off the ply pack $\mathbf{22}^2$ immediately beneath it becomes the next outermost layer and at the next blade position $\mathbf{6}^2$ is, in turn, peeled off to form the next blade $\mathbf{6}^2$. This process proceeds around the circumference of the rotor until each of the ply packs $\mathbf{22}^{1-n}$ has been peeled off in turn and the basis of the full compliment of "n" blades $\mathbf{6}^{1-n}$ has been established.

FIG. 3 illustrates in more detail, a sector of a rotor having n blades, in particular the arrangement of composite matrix ply packs in the vicinity of three blades referenced $\mathbf{6}^1$, $\mathbf{6}^2$ and $\mathbf{6}^n$. A first ply pack $\mathbf{22}^1$ is highlighted by cross hatching so it can be followed around the spiral winding of the disc 4 from its start position at $\mathbf{24}^1$ at the inner circumferential surface 8 of the centre bore of the disc 4 to the blade position $\mathbf{6}^1$ on the periphery 14 of the disc. At this location the ply pack is turned substantially radially outwards to form the basis of the blade $\mathbf{6}^1$.

The ply pack $\mathbf{22}^1$ is wound together with all of the other ply packs in a clockwise, spiral manner until it reaches the blade position $\mathbf{6}^1$. As the outermost of the ply pack layers, at position $\mathbf{6}^1$ its distal section $\mathbf{26}^1$ is turned substantially radially outwards to form a first flank of the blade $\mathbf{6}^1$. In this arrangement the end of the distal section $\mathbf{26}^1$ of the ply pack $\mathbf{22}^1$ forms the tip $\mathbf{27}^1$ of the blade $\mathbf{6}^1$.

After blade position $\mathbf{6}^1$ the next ply pack $\mathbf{22}^2$ is the outermost layer and at the next adjacent blade position $\mathbf{6}^2$ the ply pack $\mathbf{22}^2$ is turned substantially radially outwards to form a first flank of the blade $\mathbf{6}^2$. As before the distal section $\mathbf{26}^2$ of the ply pack $\mathbf{22}^2$ is turned substantially radially outwards and forms a first flank of the blade $\mathbf{6}^2$, in this example at the surface 19 on the suction side of the blade. The end of the distal section $\mathbf{26}^2$ of the ply pack $\mathbf{22}^2$ forms the tip $\mathbf{27}^2$ of the blade $\mathbf{6}^2$. This form of construction continues at each successive blade position around the rotor up to ply pack $\mathbf{22}^n$ at blade 6.

The rotor construction further includes a further ply pack 28, formed in a "U-shape", located between each pair of adjacent blades. Each ply pack 28 comprises: a first part 28*a*, which corresponds to one upright of the "U" which is equal in thickness to the ply pack 26*a* and forms the opposite flank of the blade at the surface 18 on the pressure side of the blade, and a second part 28*b*, of reduced thickness, which extends across the peripheral surface 14 of the disc 4 towards the adjacent blade and overlays the part of a ply pack 22 constituting the confronting surface 19 on the suction side of the blade of the next adjacent blade. This second part 28*b* is gradually reduced in thickness, in the limit it is made as thin as the manufacturing process will permit.

A third group of ply packs 30 constitutes an elongate filler piece of generally triangular cross-section made to fill a void which would otherwise exist at a blade location between the radial ply packs $\mathbf{26}^1$ and 28*a* of a blade flanks and the next outer circumferential layer 22 of the disc 4. The space occupied by the filler piece 30 extends the length of a blade in a chordal direction between the leading edge 16 and the trailing edge 17. Without a filler piece a cavity at the base of a blade would substantially reduce the strength of the joint between blade and disc, causing a possible failure mode.

The construction of each blade 6 is completed by a fourth ply pack 32 wrapped around the two blade flank sections $\mathbf{26}^1$ and 28*a*. This pack is relatively thinner than the other packs and helps maintain structural integrity of a blade in the event of an impact event. In addition it improves the stiffness of the aerofoil reducing or eliminating torsional modes of vibration. After the rotor ply-pack construction is complete, the assembly is impregnated by injecting an epoxy resin and the resin is then cured in an oven in an appropriate heating cycle. Impregnation in further process steps may follow to increase the proportion and density of carbon in the fibre matrix to a desired level. Reinforcement in the form of metallic strips may be incorporated in the leading edge region, or other vulnerable surfaces, of the blades to increase resistance to foreign object damage and erosion during service.

Figure 4:
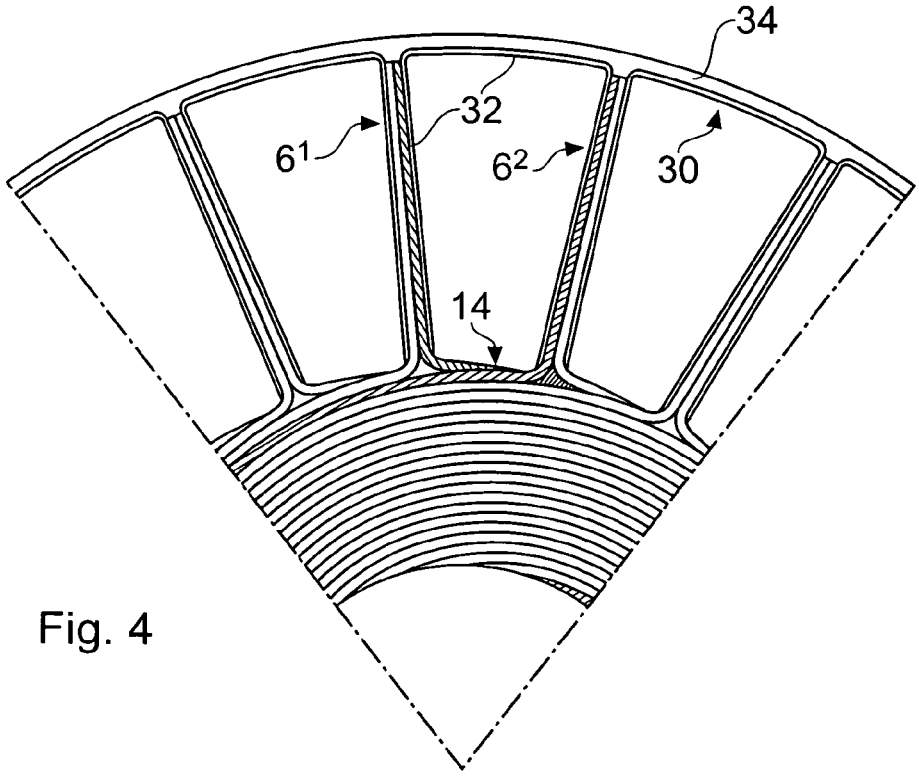
FIG. 4 shows a similar close up view of a shrouded version of the rotor.

FIG. 4 shows another version of the rotor 2 having a tip shroud, generally indicated at 30. This version is essentially a modified form of the same rotor so that like parts carry like references. The difference lies in the extra length of the second group of ply packs 32 compared to the corresponding group 28 of the first embodiment. In effect this group of ply packs 32 is made in a closed loop shape, roughly "O-shape". After the first flank $\mathbf{26}^1$ of the first blade $\mathbf{6}^1$ is in place the opposite flank is formed from a first portion of ply pack 32. A second portion of the ply pack extends across the disc periphery 14 towards the next blade $\mathbf{6}^2$ and a third portion is overlayed on the first flank of that blade out to the blade tip. At the blade tip the fourth portion of the ply pack is stretched across the gap between the tips of the second blade $\mathbf{6}^2$ and the first blade $\mathbf{6}^1$. the procedure is repeated between the next pair of adjacent blades and so on around the rotor. Finally a further group 34 of elongate ply packs is wound around the outside of all of the "O-shaped" ply packs 32 thus forming the encircling tip shroud 30.

The invention claimed is:

1. An integrally bladed rotor comprising a disc portion having a disc periphery around which there are spaced apart a plurality of blade positions, and at each blade position there is formed a generally radially extending blade, wherein the disc portion is made up of a plurality of layers of organic matrix material wound together in a spiral fashion to form the disc portion, the outermost layer of the plurality of layers of organic matrix material defines the disc periphery, and at each blade position at least the outermost of said layers is turned substantially radially outwards to form a blade, such that at successive blade positions in turn spaced apart around the disc the periphery is defined by a newly revealed layer of organic matrix material which forms a blade at the next blade position.

2. An integrally bladed rotor as claimed in claim 1 wherein successive layers in turn are made upstanding to form successive blades spaced apart around the periphery of the disc.

3. An integrally bladed rotor as claimed in claim 1 wherein the number of layers of organic matrix material is equal to the number of blade positions.

4. An integrally bladed rotor as claimed in claim 1 wherein the layer of organic matrix material turned substantially radially outwards to form a blade forms one side surface of a blade.

5. An integrally bladed rotor as claimed in claim 1 wherein an opposite side surface of a blade is formed by at least one additional layer of organic matrix material.

6. An integrally bladed rotor as claimed in claim 5 wherein the at least one additional layer of organic matrix material is "L" shaped and forms the side surface of a blade and extends towards the next blade position to overlay the revealed layer forming the periphery of the disc.

7. An integrally bladed rotor as claimed in claim 1 further comprising a filler piece of organic matrix material fitted at the base of blade at the region of divergence of a wound organic matrix material layer.

8. An integrally bladed rotor as claimed in claim 1 wherein each blade is wrapped by a further layer of organic matrix material.

9. A method of manufacturing an integrally bladed rotor as claimed in claim 1 comprising the steps of laying up a plurality of layers of organic matrix material wound together in spiral fashion to form the disc portion of the rotor, and in turn at each blade position at least the successively outermost one of said layers is turned substantially radially outwards to form a blade.

10. A method of manufacturing an integrally bladed rotor as claimed in claim 2 comprising the steps of laying up a plurality of layers of organic matrix material wound together in spiral fashion to form the disc portion of the rotor, and in turn at each blade position at least the successively outermost one of said layers is turned substantially radially outwards to form a blade.

11. A method of manufacturing an integrally bladed rotor as claimed in claim 3 comprising the steps of laying up a plurality of layers of organic matrix material wound together in spiral fashion to form the disc portion of the rotor, and in turn at each blade position at least the successively outermost one of said layers is turned substantially radially outwards to form a blade.

12. A method of manufacturing an integrally bladed rotor as claimed in claim 4 comprising the steps of laying up a plurality of layers of organic matrix material wound together in spiral fashion to form the disc portion of the rotor, and in turn at each blade position at least the successively outermost one of said layers is turned substantially radially outwards to form a blade.

13. A method of manufacturing an integrally bladed rotor as claimed in claim 5 comprising the steps of laying up a plurality of layers of organic matrix material wound together in spiral fashion to form the disc portion of the rotor, and in turn at each blade position at least the successively outermost one of said layers is turned substantially radially outwards to form a blade.

14. A method of manufacturing an integrally bladed rotor as claimed in claim 6 comprising the steps of laying up a plurality of layers of organic matrix material wound together in spiral fashion to form the disc portion of the rotor, and in turn at each blade position at least the successively outermost one of said layers is turned substantially radially outwards to form a blade.

15. A method of manufacturing an integrally bladed rotor as claimed in claim 7 comprising the steps of laying up a plurality of layers of organic matrix material wound together in spiral fashion to form the disc portion of the rotor, and in turn at each blade position at least the successively outermost one of said layers is turned substantially radially outwards to form a blade.

16. A method of manufacturing an integrally bladed rotor as claimed in claim 8 comprising the steps of laying up a plurality of layers of organic matrix material wound together in spiral fashion to form the disc portion of the rotor, and in turn at each blade position at least the successively outermost one of said layers is turned substantially radially outwards to form a blade.

* * * * *